US010344758B2

(12) United States Patent
Underys et al.

(10) Patent No.: US 10,344,758 B2
(45) Date of Patent: Jul. 9, 2019

(54) PRECIPITATION HARDENED MARTENSITIC STAINLESS STEEL AND RECIPROCATING PUMP MANUFACTURED THEREWITH

(71) Applicant: A. Finkl & Sons Co., Chicago, IL (US)

(72) Inventors: Algirdas Underys, Chicago, IL (US); Jesse Adamson, Chicago, IL (US); Mark Shirley, Chicago, IL (US)

(73) Assignee: A. FINKL & SONS CO., Chicago, IL (US)

( * ) Notice: Subject to any disclaimer, the term of this patent is extended or adjusted under 35 U.S.C. 154(b) by 165 days.

(21) Appl. No.: 15/477,764

(22) Filed: Apr. 3, 2017

(65) Prior Publication Data

US 2017/0292515 A1 Oct. 12, 2017

Related U.S. Application Data

(60) Provisional application No. 62/319,406, filed on Apr. 7, 2016.

(51) Int. Cl.
*F04B 53/16* (2006.01)
*C21D 6/00* (2006.01)
(Continued)

(52) U.S. Cl.
CPC ..... *F04B 53/16* (2013.01); *C21D 6/004* (2013.01); *C21D 6/02* (2013.01); *C22C 38/00* (2013.01);
(Continued)

(58) Field of Classification Search
CPC ..... F04B 19/22; F04B 1/0404; F04B 53/16; C21D 6/02; C22C 38/16; C22C 38/18
See application file for complete search history.

(56) References Cited

U.S. PATENT DOCUMENTS 5,714,114 A * 2/1998 Uehara ..... C22C 38/20 148/325
7,361,236 B2 * 4/2008 Kondo ..... C22C 38/42 148/325
(Continued)

FOREIGN PATENT DOCUMENTS

CN 202 100 406 U 1/2012
JP H08 134623 A 5/1996
(Continued)

OTHER PUBLICATIONS

International Search Report related to Application No. EP17165399 filed on Jul. 27, 2017.
(Continued)

*Primary Examiner* — Thomas E Lazo
(74) *Attorney, Agent, or Firm* — Miller, Matthias & Hull LLP

(57) ABSTRACT

An end block is disclosed. The end block may include a body extending between a front side, a back side, a left side, a right side, a top side and a bottom side. Furthermore, the body may include a first bore extending through the body between an inlet port and an outlet port and a cylinder bore extending between a cylinder port and the first bore. Moreover, the body may include a precipitation hardened martensitic stainless steel comprising between 0.08% and 0.18% by weight carbon, between 10.50% and 14.00% by weight chromium, between 0.65% and 1.15% by weight nickel, between 0.85% and 1.30% by weight copper, iron, and a first precipitate comprising the copper.

26 Claims, 6 Drawing Sheets

(51) Int. Cl.

| | |
|---|---|
| ***C21D 6/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***F04B 19/22*** | (2006.01) |
| ***F04B 1/04*** | (2006.01) |
| ***F04B 1/053*** | (2006.01) |
| ***F04B 9/04*** | (2006.01) |
| *F04B 53/00* | (2006.01) |
| *F04B 53/14* | (2006.01) |
| *C21D 9/00* | (2006.01) |
| *C21D 9/44* | (2006.01) |
| *C22C 38/08* | (2006.01) |
| *C22C 38/12* | (2006.01) |
| *C22C 38/18* | (2006.01) |
| *C22C 38/20* | (2006.01) |
| *C22C 38/22* | (2006.01) |
| *C22C 38/24* | (2006.01) |
| *C22C 38/40* | (2006.01) |
| *F04B 51/00* | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *F04B 1/0404* (2013.01); *F04B 1/053* (2013.01); *F04B 9/045* (2013.01); *F04B 19/22* (2013.01); *C21D 6/001* (2013.01); *C21D 6/002* (2013.01); *C21D 6/005* (2013.01); *C21D 6/008* (2013.01); *C21D 9/0025* (2013.01); *C21D 9/0068* (2013.01); *C21D 9/44* (2013.01); *C21D 2211/008* (2013.01); *C22C 38/08* (2013.01); *C22C 38/12* (2013.01); *C22C 38/18* (2013.01); *C22C 38/20* (2013.01); *C22C 38/22* (2013.01); *C22C 38/24* (2013.01); *C22C 38/40* (2013.01); *F04B 51/00* (2013.01); *F04B 53/006* (2013.01); *F04B 53/144* (2013.01)

(56) References Cited

U.S. PATENT DOCUMENTS

| | | | | |
|---|---|---|---|---|
| 8,157,930 | B2 † | 4/2012 | Amaya | |
| 2005/0274436 | A1 | 12/2005 | Kondo et al. | |
| 2016/0130679 | A1 * | 5/2016 | Cober ..... | C21D 9/0068 148/219 |

FOREIGN PATENT DOCUMENTS

| | | | |
|---|---|---|---|
| JP | 2000 239805 | A | 9/2000 |
| JP | 2007 070654 | A | 3/2007 |

OTHER PUBLICATIONS

Marco Boniardi and Andrea Casaroli; "Stainless Steels"; Book; 2014; Lucefin S.p.A.; pp. 115 and 124.

Russell H. Jones; "Stress-Corrosion Cracking, Materials Performance and Evaluation"; Second Edition; ASM International; 2017, pp. 100-101.

European Patent Office, Communication from the Examining Division, Application No. EP 17165399.1 to A Finkl & Sons Co., May 24, 2018 (8 pages).†

* cited by examiner
† cited by third party

PRECIPITATION HARDENED MARTENSITIC STAINLESS STEEL AND RECIPROCATING PUMP MANUFACTURED THEREWITH

CROSS-REFERENCE TO RELATED APPLICATION

This is a non-provisional US patent application claiming priority under 35 U.S.C. § 119(e) to U.S. Provisional Patent Application No. 62/319,406 filed on Apr. 7, 2016.

TECHNICAL FIELD

This disclosure generally relates to a precipitation hardened martensitic stainless steel and, more particularly, to end blocks and reciprocating pumps made from same.

BACKGROUND

A reciprocating pump may be configured to propel a treatment material, such as, but not limited to, concrete, an acidizing material, a hydraulic fracturing material or a proppant material, into a gas or oil wellbore. The reciprocating pump includes a power end and a fluid end, with the power end including a motor and a crankshaft rotationally engaged with the motor. Moreover, the power end includes a crank arm rotationally engaged with the crankshaft.

The fluid end may include a connecting rod operatively connected to the crank arm at one end and to a plunger at the other end, a cylinder configured to operatively engage the plunger and an end block configured to engage the cylinder. An inlet port is provided in the end block with an outlet port and a first bore extending between the inlet port and the outlet port. Moreover, the end block includes a cylinder port and a cylinder bore extending between the cylinder port and the first bore. As the motor operates, it rotates the crankshaft, which in turn reciprocates the plunger inside the cylinder via the crank arm and the connecting rod. As the plunger reciprocates, the treatment material is moved into the end block through the inlet port and propelled out of the end block through the outlet port under pressure to the gas or oil wellbore.

As demand for hydrocarbons has increased, hydraulic fracturing companies have moved into drilling more complex fields such as Haynesville Shale. Where older formations could be fractured at 9000 pounds per square inch (PSI), Haynesville Shale commonly requires pumping pressure upwards of 13000 PSI. Moreover, where older formations could utilize less abrasive proppant materials, Haynesville Shale customarily requires a highly abrasive proppant such as bauxite. The higher pumping pressure and utilization of more abrasive proppant materials has led to decreased fluid end life, and thus higher costs associated with replacement end blocks and pumps.

The present disclosure is therefore directed to overcoming one or more problems set forth above and/or other problems associated with known reciprocating pump fluid ends.

SUMMARY

In accordance with one aspect of the present disclosure, a precipitation hardened martensitic stainless steel is disclosed. The precipitation hardened martensitic stainless steel may comprise between 0.08% and 0.18% by weight carbon, between 10.50% and 14.00% by weight chromium, between 0.65% and 1.15% by weight nickel, between 0.85% and 1.30% by weight copper, and iron. In addition, the precipitation hardened martensitic stainless steel may comprise a first precipitate comprising the copper.

In accordance with another aspect of the present disclosure, an end block is disclosed. The end block may comprise a body extending between a front side, a back side, a left side, a right side, a top side and a bottom side. Moreover, the body may include a first bore extending through the body between an inlet port and an outlet port and further include a cylinder bore extending between a cylinder port and the first bore. Additionally, the body may include a precipitation hardened martensitic stainless steel. The precipitation hardened martensitic stainless steel may comprise between 0.08% and 0.18% by weight carbon, between 10.50% and 14.00% by weight chromium, between 0.65% and 1.15% by weight nickel, between 0.85% and 1.30% by weight copper, and iron. In addition, the precipitation hardened martensitic stainless steel may comprise a first precipitate comprising the copper.

In accordance with another aspect of the present disclosure, a reciprocating pump is disclosed. The reciprocating pump may include a crankshaft and a connecting rod rotationally engaged with the crankshaft. In addition, the reciprocating pump may include a plunger operatively connected to the connecting rod and a cylinder configured to operatively engage the plunger. Moreover, the reciprocating pump may include an end block and the end block may comprise a body extending between a front side, a back side, a left side, a right side, a top side and a bottom side. Furthermore, the body may comprise a first bore extending through the body between an inlet port and an outlet port and a cylinder bore extending between a cylinder port and the first bore. Additionally, the body may comprise a precipitation hardened martensitic stainless steel. The precipitation hardened martensitic stainless steel may comprise between 0.08% and 0.18% by weight carbon, between 10.50% and 14.00% by weight chromium, between 0.65% and 1.15% by weight nickel, between 0.85% and 1.30% by weight copper, and iron. In addition, the precipitation hardened martensitic stainless steel may comprise a first precipitate comprising the copper.

These and other aspects and features of the present disclosure will be more readily understood when read in conjunction with the accompanying drawings.

BRIEF DESCRIPTION

DETAILED DESCRIPTION OF THE DISCLOSURE

Figure 1:
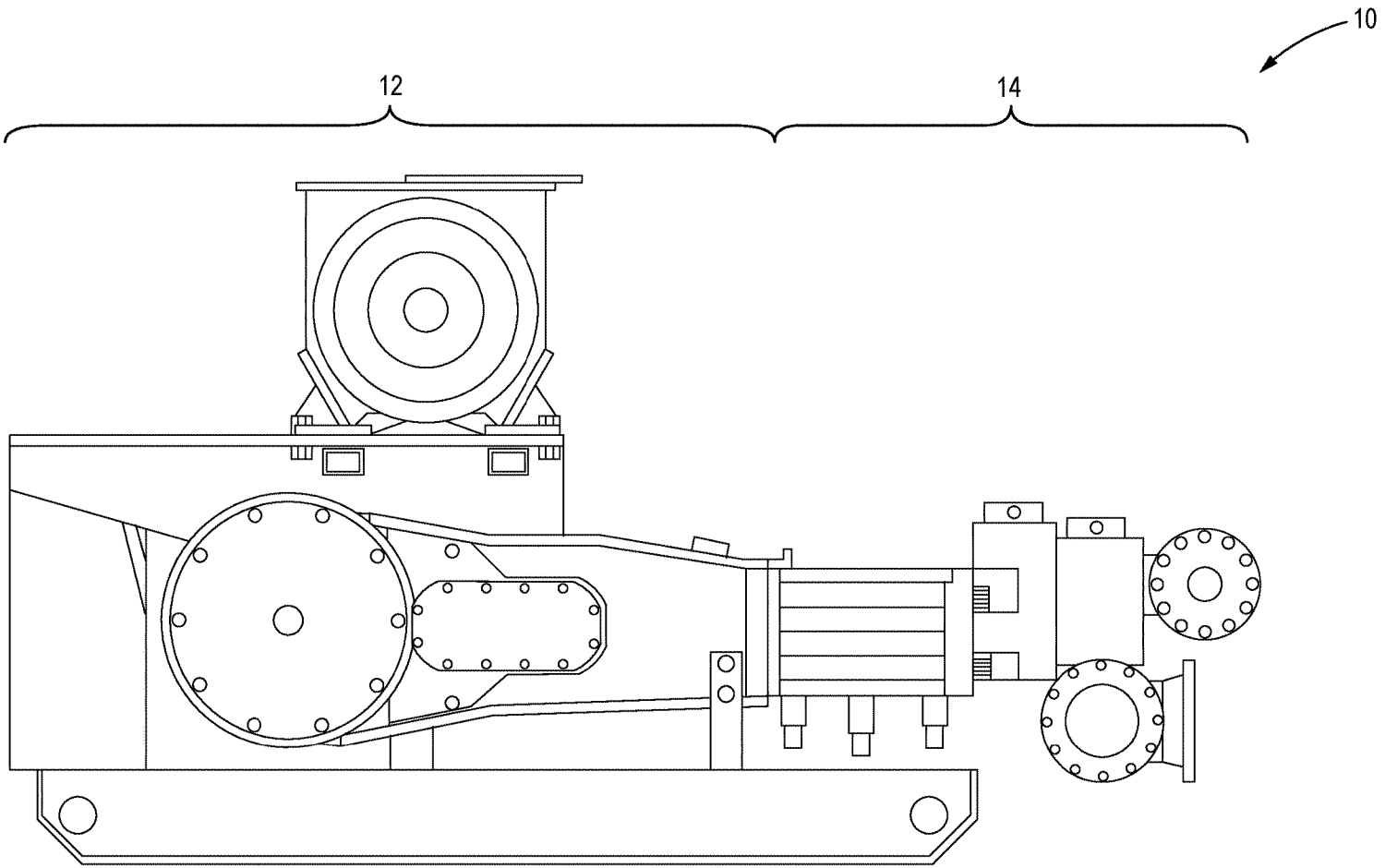
FIG. 1 is a side elevation view of an exemplary reciprocating pump manufactured in accordance with the present disclosure.

Various aspects of the disclosure will now be described with reference to the drawings and tables disclosed herein, wherein like reference numbers refer to like elements, unless specified otherwise. Referring to FIG. 1, a side elevation view of an exemplary reciprocating pump 10 manufactured in accordance with the present disclosure is depicted. As represented therein, the reciprocating pump 10 may include a power end 12 and a fluid end 14. The power end 12 may be configured to provide work to the fluid end 14 thereby allowing the fluid end 14 to propel a treatment material, such as, but not limited to, concrete, an acidizing material, a hydraulic fracturing material or a proppant material, into a gas or oil wellbore.

Figure 2:
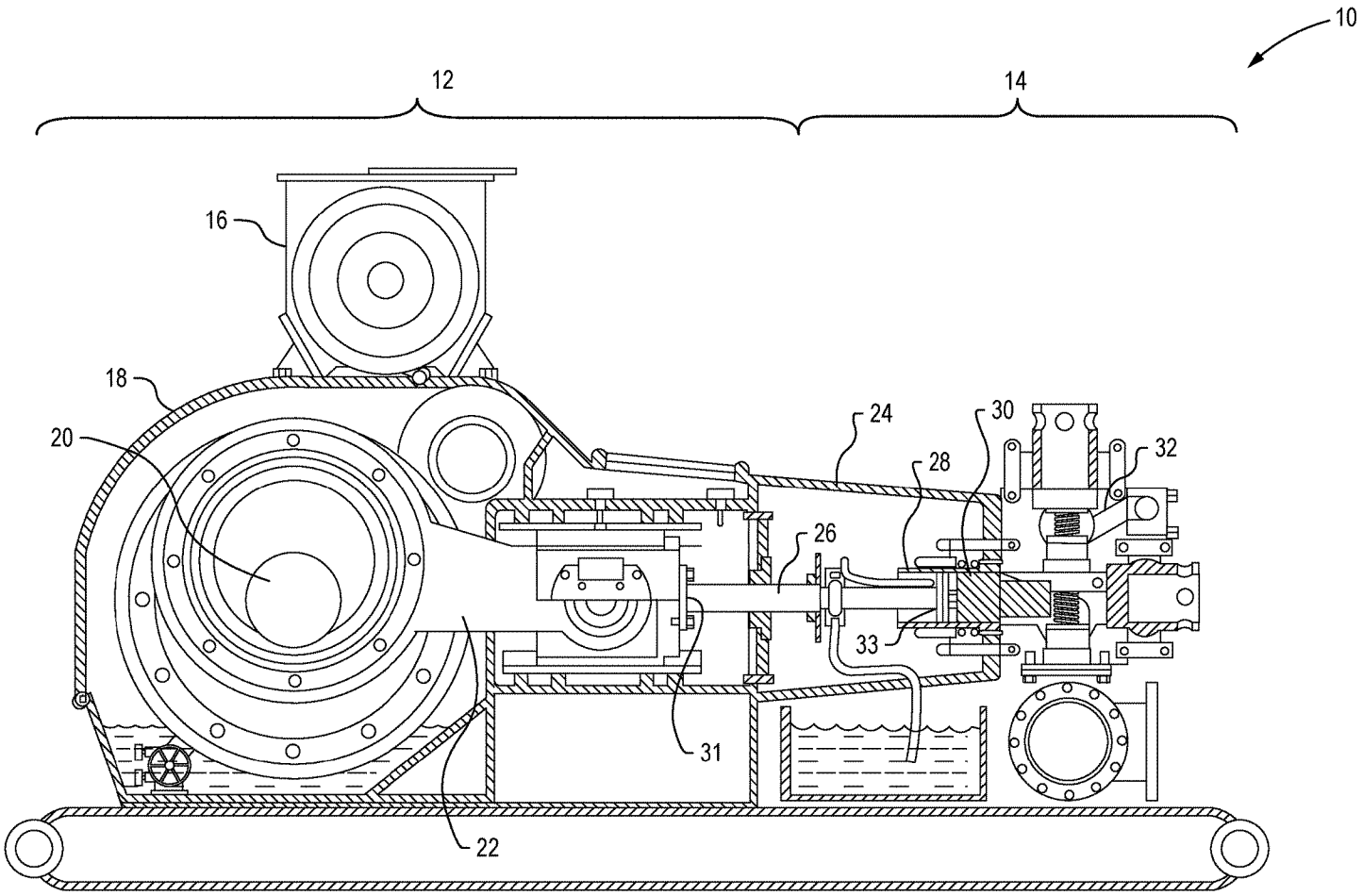
FIG. 2 is a side cross-sectional view of the exemplary reciprocating pump according to FIG. 1 manufactured in accordance with the present disclosure.

Referring now to FIG. 2, a side cross-sectional view of the exemplary reciprocating pump 10 according to FIG. 1 manufactured in accordance with the present disclosure is depicted. As seen therein, the power end 12 may include a motor 16 configured to provide work to the fluid end 14. Moreover, the power end 12 may include a crankcase housing 18 surrounding a crankshaft 20 and a crank arm 22. The crankshaft 20 may be rotationally engaged with the motor 16 and the crank arm 22 may be rotationally engaged with the crankshaft 20.

The fluid end 14 may include a fluid housing 24 at least partially surrounding a connecting rod 26, a cylinder 28 and a plunger 30. The connecting rod 26 may include a first end 31 and a second end 33 opposite the first end 31. The connecting rod 26 may be operatively connected to the crank arm 22 at the first end 31 and to the plunger 30 at the second end 33. The cylinder 28 may be configured to operatively engage the plunger 30. While the current disclosure and drawings discuss a cylinder 28 and plunger 30 arrangement, it is envisioned that the teachings of the current disclosure may also encompass a cylinder 28 and piston arrangement. Accordingly, it is to be understood that the plunger 30 may be replaced by a piston without departure from the scope of the current disclosure.

Figure 3:
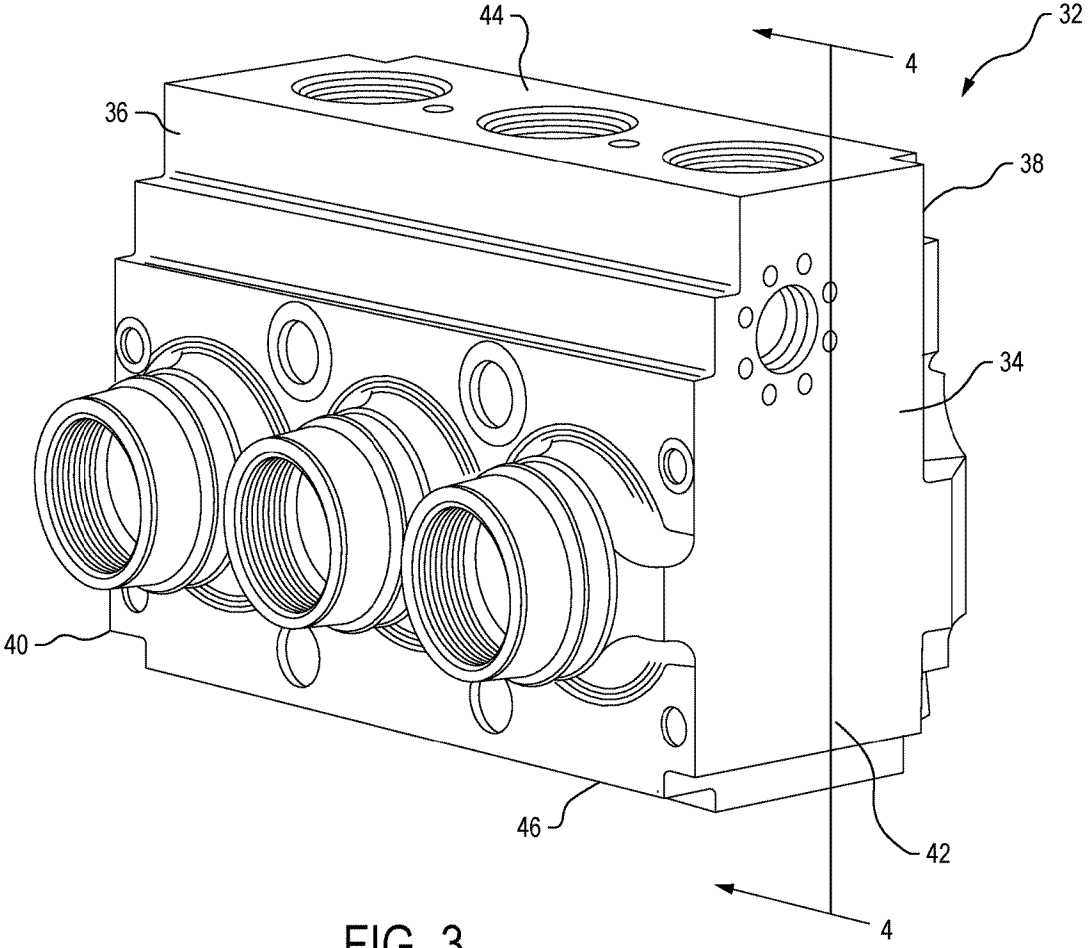
FIG. 3 is a perspective view of an end block that may be utilized with the exemplary reciprocating pump of FIG. 1 manufactured in accordance with the present disclosure.

The fluid end 14 may also include an end block 32. Turning now to FIG. 3, a perspective view of an end block 32 that may be utilized with the exemplary reciprocating pump 10 of FIG. 1 manufactured in accordance with the present disclosure is depicted. As depicted therein, the end block 32 may comprise a body 34 extending between a front side 36, a back side 38, a left side 40, a right side 42, a top side 44 and a bottom side 46. While the end block 32 depicted in FIG. 3 is a monoblock triplex design, it is envisioned that the teachings of the present disclosure apply equally as well to other monoblock designs such as quintuplex, Y-block, and even to an end block 32 having a modular design.

Figure 4:
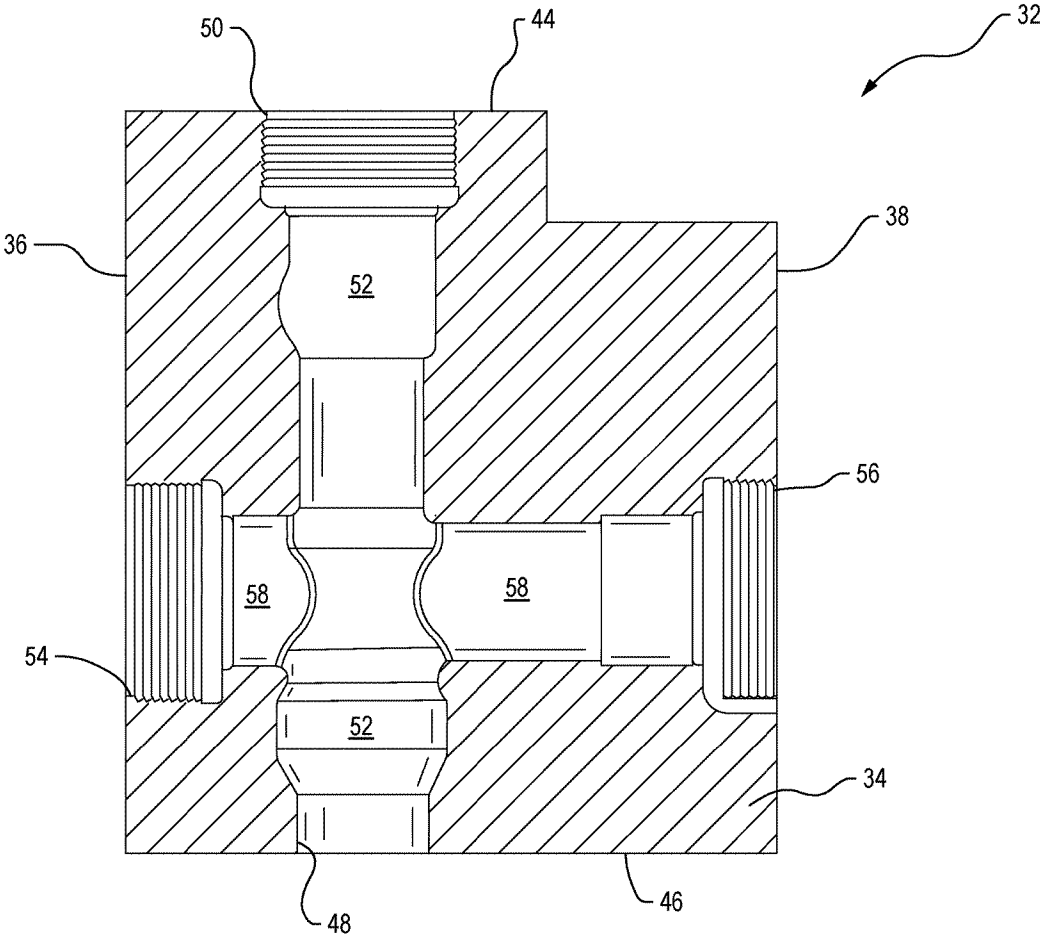
FIG. 4 is a cross-sectional view of one embodiment of the end block of FIG. 3 along line 4-4 that may be utilized with the exemplary reciprocating pump of FIG. 1 manufactured in accordance with the present disclosure.

Turning to FIG. 4, a cross-sectional view of one embodiment of the end block 32 of FIG. 3 along line 4-4 is illustrated. As depicted therein the body 34 may further include an inlet port 48, an outlet port 50 and a first bore 52 extending between the inlet port 48 and the outlet port 50. Moreover, as is depicted in FIG. 4, the body 34 may additionally include a cylinder port 54, an inspection port 56 and a cylinder bore 58. In one embodiment the cylinder bore 58 may extend between the cylinder port 54 and the first bore 52. In another embodiment, the cylinder bore 58 may extend between the cylinder port 54 and the inspection port 56.

Figure 5:
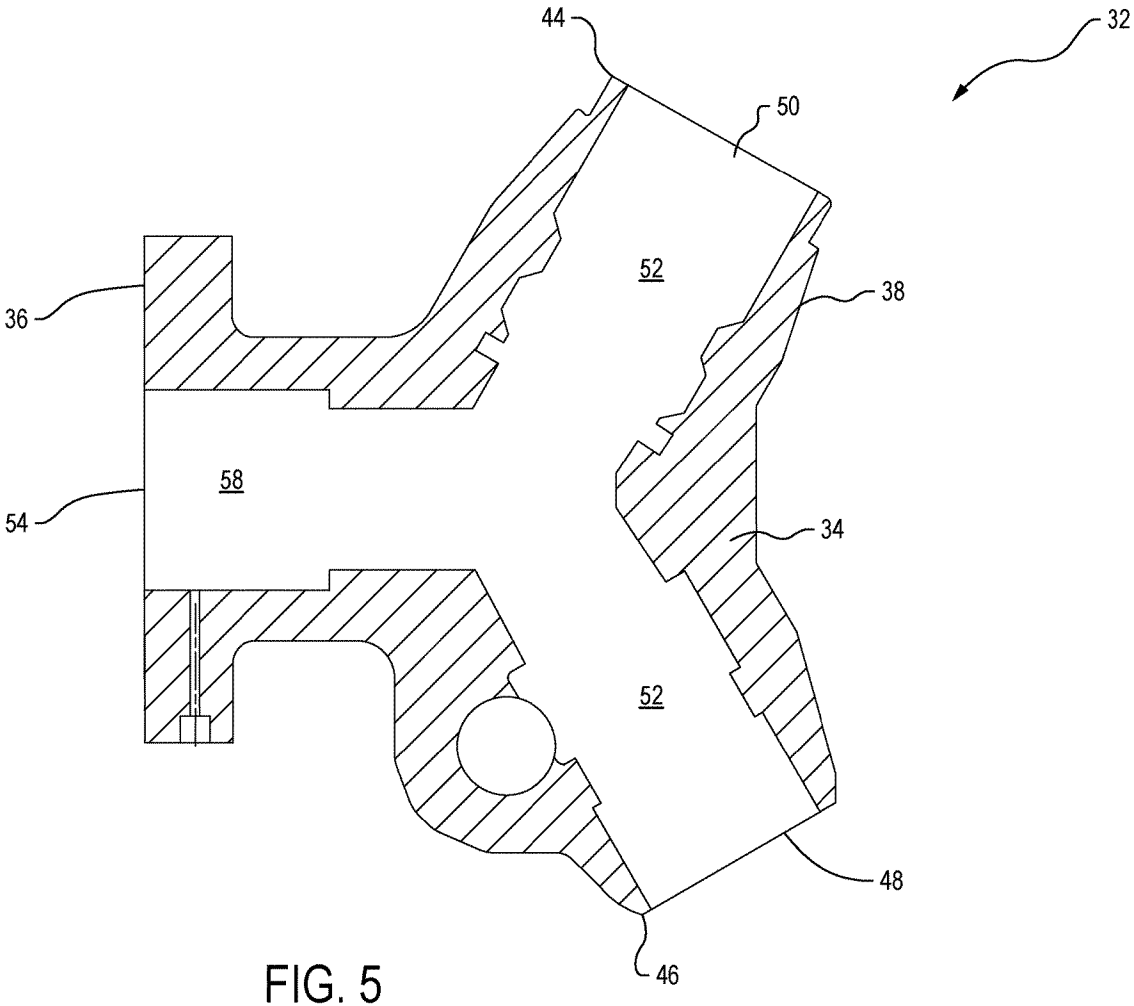
FIG. 5 is a cross-sectional view of an alternative embodiment of the end block of FIG. 3 along line 4-4 that may be utilized with the exemplary reciprocating pump of FIG. 1 manufactured in accordance with the present disclosure.

Referring to FIG. 5, a cross-sectional view of an alternative embodiment of the end block 32 of FIG. 3 along line 4-4 is illustrated. As depicted therein the body 34 may further include an inlet port 48, an outlet port 50 and a first bore 52 extending between the inlet port 48 and the outlet port 50. Moreover, as is depicted in FIG. 5, the body 34 may additionally include a cylinder port 54 and a cylinder bore 58. The cylinder bore 58 may extend between the cylinder port 54 and the first bore 52. Furthermore, as illustrated therein, an angle between the cylinder bore 58 and the first bore 52 may be other than 90 degrees, thereby giving rise to the end block 32 having a Y-block styled configuration.

In operation, the motor 16 may rotate the crankshaft 20, which may in turn reciprocate the plunger 30 inside the cylinder 28 via the crank arm 22 and the connecting rod 26. As the plunger 30 reciprocates from the cylinder bore 58 towards the cylinder 28, treatment material may be moved into the first bore 52 through the inlet port 48. As plunger 30 reciprocates from the cylinder 28 towards the cylinder bore 58, the treatment material may be moved out of the first bore 52 through the outlet port 50 under pressure to the gas or oil wellbore.

As described above, the demand for hydrocarbon energy has increased. Accordingly, hydraulic fracturing companies have started exploring shale fields that require increased pressures and the use of more abrasive proppant materials to release the captured hydrocarbons. The higher pumping pressure and utilization of more abrasive proppant materials, such as bauxite, has decreased the service life of the fluid end 14. More specifically, the higher pumping pressures and utilization of more abrasive proppant materials has decreased the service life of the cylinder 28, the plunger 30 and the end block 32. Accordingly, the present disclosure is directed to increasing the service life of these parts.

More particularly, the present disclosure is directed to a novel and non-obvious precipitation hardened martensitic stainless steel having increased corrosion resistance in comparison to materials conventionally utilized to manufacture the cylinder 28, the plunger 30 and the end block 32 of the fluid end 14 of the reciprocating pump 10 described above while maintaining adequate yield strength and ultimate tensile strength for the application. More specifically, in a first embodiment, the present disclosure is directed to a precipitation hardened martensitic stainless steel comprising between 0.08% and 0.18% by weight carbon, between 10.50% and 14.00% by weight chromium, between 0.65% and 1.15% by weight nickel, between 0.85% and 1.30% by weight copper, iron, and a first precipitate comprising the copper. Moreover, in this embodiment, the precipitation hardened martensitic stainless steel may further comprise between 0.40% and 0.60% by weight molybdenum and a second precipitate comprising the molybdenum. In addition, this embodiment of the precipitation hardened martensitic stainless steel may additionally comprise between 0.30% and 1.00% by weight manganese. Furthermore, in this embodiment, the precipitation hardened martensitic stainless steel may comprise between 0% and 0.040% by weight phosphorus. Moreover, the precipitation hardened martensitic stainless steel in this embodiment may comprise between 0% and 0.100% by weight sulfur. Additionally, the precipitation hardened martensitic stainless steel in this embodiment may comprise between 0.15% and 0.65% by weight silicon. Furthermore, the precipitation hardened martensitic stainless steel in this embodiment may comprise between 0% and 0.15% by weight vanadium. In addition, the precipitation hardened martensitic stainless steel in this embodiment may comprise between 0% and 0.15% by weight niobium. Lastly, in this embodiment, the precipitation hardened martensitic stainless steel may comprise between 0.01% and 0.09% by weight aluminum.

In the first embodiment, the yield strength of the precipitation hardened martensitic stainless steel may range between 95.0 thousands of pounds per square inch (KSI) and 130.0 KSI with an average yield strength of 105.0 KSI for the best balance of strength and ductility. Moreover, in this first embodiment, the precipitation hardened stainless steel may have an ultimate tensile strength between 110 KSI to 141 KSI with an average ultimate tensile strength of 123.0 KSI for the best balance of strength and ductility.

In an additional embodiment, the precipitation hardened martensitic stainless steel may comprise between 0.10% and 0.18% by weight carbon, between 11.50% and 14.00% by weight chromium, between 0.65% and 1.15% by weight nickel, between 0.85% and 1.30% by weight copper, iron, and a first precipitate comprising the copper. Moreover, in this additional embodiment, the precipitation hardened martensitic stainless steel may further comprise between 0.40% and 0.60% by weight molybdenum and a second precipitate comprising the molybdenum. In addition, in this additional embodiment the precipitation hardened martensitic stainless steel may additionally comprise between 0.30% and 0.80% by weight manganese. Furthermore, in this additional embodiment, the precipitation hardened martensitic stainless steel may comprise between 0% and 0.040% by weight phosphorus. Moreover, the precipitation hardened martensitic stainless steel in this additional embodiment may comprise between 0% and 0.100% by weight sulfur. Additionally, the precipitation hardened martensitic stainless steel in this additional embodiment may comprise between 0.25% and 0.60% by weight silicon. Furthermore, in this additional embodiment, the precipitation hardened martensitic stainless steel may comprise between 0% and 0.15% by weight vanadium. In addition, the precipitation hardened martensitic stainless steel in this additional embodiment may comprise between 0% and 0.15% by weight niobium. Lastly, in this additional embodiment, the precipitation hardened martensitic stainless steel may comprise between 0.01% and 0.09% by weight aluminum.

In this additional embodiment, the yield strength of the precipitation hardened martensitic stainless steel may range between 95.0 thousands of pounds per square inch (KSI) and 130.0 KSI with an average yield strength of 105.0 KSI for the best balance of strength and ductility. Moreover, in this additional embodiment, the precipitation hardened stainless steel may have an ultimate tensile strength between 110 KSI to 141 KSI with an average ultimate tensile strength of 123.0 KSI for the best balance of strength and ductility.

In a further embodiment, the precipitation hardened martensitic stainless steel may comprise between 0.13% and 0.18% by weight carbon, between 12.00% and 13.50% by weight chromium, between 0.65% and 0.95% by weight nickel, between 1.00% and 1.30% by weight copper, iron, and a first precipitate comprising the copper. Moreover, in this further embodiment, the precipitation hardened martensitic stainless steel may further comprise between 0.43% and 0.57% by weight molybdenum and a second precipitate comprising the molybdenum. In addition, in this further embodiment the precipitation hardened martensitic stainless steel may additionally comprise between 0.30% and 0.50% by weight manganese. Furthermore, in this further embodiment, the precipitation hardened martensitic stainless steel may comprise between 0% and 0.040% by weight phosphorus. Moreover, the precipitation hardened martensitic stainless steel in this further embodiment may comprise between 0% and 0.010% by weight sulfur. Additionally, the precipitation hardened martensitic stainless steel in this further embodiment may comprise between 0.30% and 0.50% by weight silicon. Furthermore, in this further embodiment, the precipitation hardened martensitic stainless steel may comprise between 0% and 0.15% by weight vanadium. Furthermore, the precipitation hardened martensitic stainless steel in this further embodiment may comprise between 0% and 0.07% by weight niobium. In addition, the combined contents of vanadium and niobium in the precipitation hardened martensitic stainless steel in this further embodiment may be limited to a maximum of 0.15% by weight. Lastly, in this further embodiment, the precipitation hardened martensitic stainless steel may comprise between 0.015% and 0.045% by weight aluminum.

In this further embodiment, the yield strength of the precipitation hardened martensitic stainless steel may range between 95.0 thousands of pounds per square inch (KSI) and 130.0 KSI with an average yield strength of 105.0 KSI for the best balance of strength and ductility. Moreover, in this further embodiment, the precipitation hardened stainless steel may have an ultimate tensile strength between 110 KSI to 141 KSI with an average ultimate tensile strength of 123.0 KSI for the best balance of strength and ductility.

The carbon in the above-described formulas may determine the as quenched hardness, increases the precipitation hardened martensitic stainless steel's hardenability, and is a potent austenite stabilizer. Additionally, carbon may combine with chromium and molybdenum to form a number of metal carbide phases. Metal carbide particles enhance wear resistance and the MC type metal carbide provides grain refinement through particle pinning. To ensure adequate metal carbide formation for wear resistance and grain refinement and to impart the necessary as quenched hardness, a minimum carbon content of 0.08% by weight is required. Increasing the carbon level above 0.18% by weight, however, is undesirable. First, the precipitation of chromium carbides depletes the matrix of beneficial chromium which lowers the alloy's oxidation and corrosion resistance. Second, higher carbon levels can over-stabilize the austenite phase. Incomplete transformation can result from the over-stabilized austenite, which can depress the martensite start and finish temperatures below room temperature with deleterious affect on the strength of the implement.

The chromium in the above-expressed formulas may moderately enhance hardenability, mildly impart solid solution strengthening, and greatly improve wear resistance when combined with carbon to form metal carbide. When present in concentrations above 10.5% by weight, chromium offers high oxide and corrosion resistance. In practice, up to 14.0 weight % can be added without reducing the hot workability of the precipitation hardened martensitic stainless steel.

The nickel of the above-described formulas may impart minor solid solution strengthening, extend hardenability, and increase toughness and ductility. Moreover the nickel may improve the corrosion resistance in acidic environments, and may be a strong austenite stabilizer. Nickel may also increase the solubility of copper in liquid iron and control surface cracking during forging. Additionally, nickel may also mitigate the tendency of copper to migrate to grain boundaries during forging. One preferred minimum ratio of nickel to copper is 50%.

Figure 6:
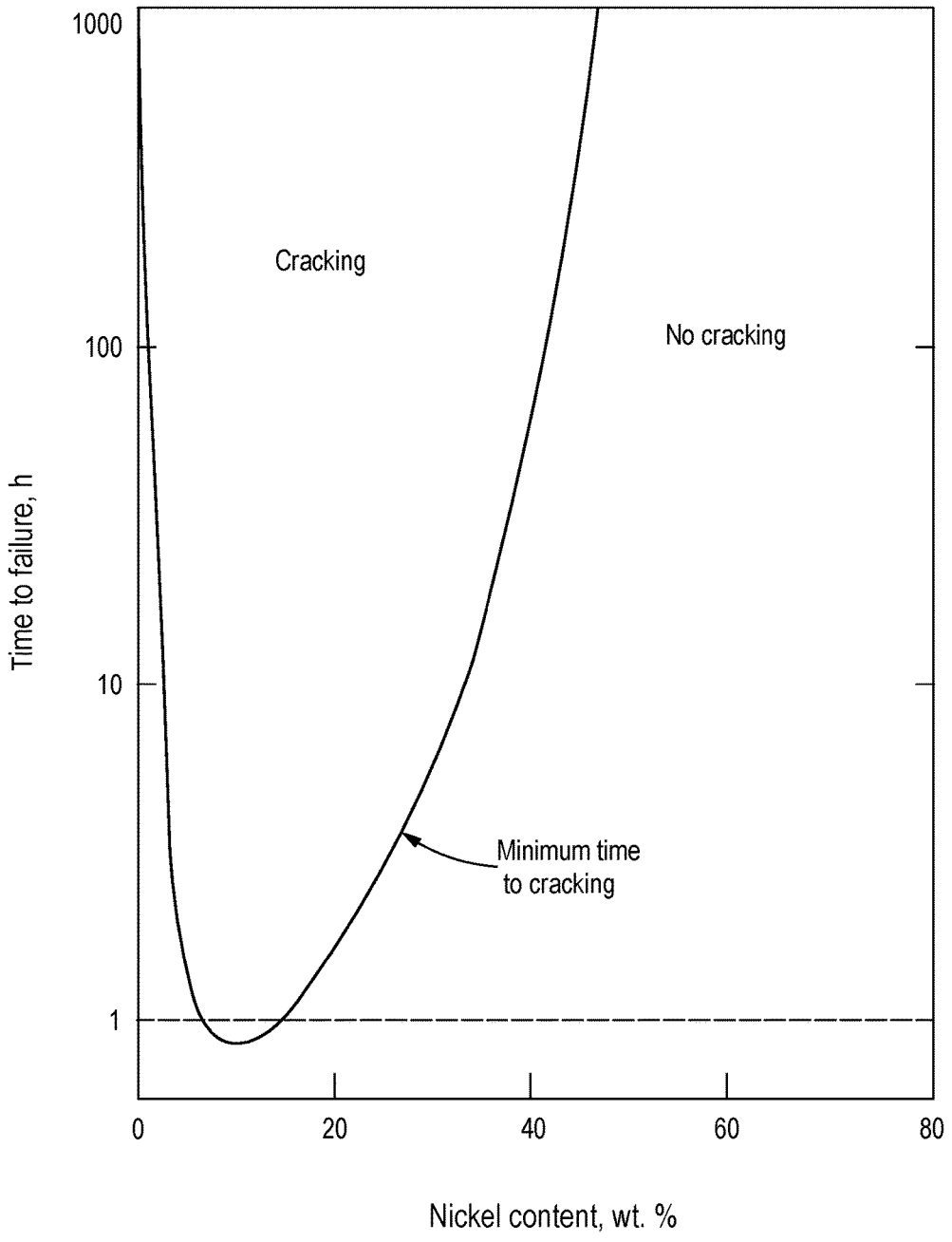
FIG. 6 is a data plot showing the effect of nickel content on stress corrosion cracking (SCC) in stainless steel wires.

The failure mode of end blocks and reciprocating pumps may not be completely understood. What is known, however, its that a given material, which is subjected to a combination of tensile stresses and a corrosive aqueous solution, may be prone to initiation and then propagation of a crack. The susceptibility of a material to stress corrosion cracking (SCC) may be due to the alloy composition, microstructure, and thermal history. It has been shown that the nickel content of a stainless steel has an effect on the time to failure due to SCC (see FIG. 6 and Jones, Russel H., *Stress-Corrosion Cracking: Materials, Performance, and Evaluation*, Second Edition, ASM International, 2017, pp. 100-101). From the plot of FIG. 6, it may be noted that as the nickel concentration increases from 0% to approximately 12.5%, the susceptibility to SCC increases. Therefore, keeping the nickel concentration below 1.15% may increase the resistance of a stainless steel to SCC as compared to higher nickel concentrations.

The copper described above may augment the hardenability slightly, improve the oxidation resistance, improve the corrosion resistance against certain acids, and impart strength through precipitation of copper rich particles. Copper levels between 0.85% and 1.30% by weight allow gains in oxidation and corrosion resistance, as well as precipitation hardening, without significantly lowering the martensitic transformation temperature. The copper increases the fluidity of liquid steel, and 1.0% by weight copper has the equivalent affect as a 125° F. rise in liquid steel temperature with regards to fluidity. The maximum solubility of copper in iron is 1.50% by weight when cooled quickly, and should be kept below 1.30% by weight for the precipitation hardened martensitic stainless steel described above.

The molybdenum in the afore-described formulas may improve the hardenability, increase corrosion resistance, reduce the propensity of temper embrittlement, and yield a strengthened precipitation hardened martensitic stainless steel when heated in the 1000° F. to 1200° F. range by precipitation of fine metal carbide ($M_2C$). The molybdenum rich metal carbides provide increased wear resistance, improve hot hardness and resist coarsening below the $A_1$ temperature. Moreover, molybdenum quantities up to 0.60% by weight allow these benefits to be realized without compromising hot workability. Molybdenum improves the impact resistance of copper bearing steels and in one preferred ratio should be present in an amount approximately half of the copper % by weight.

The manganese of the above-described formulas may provide mild solid solution strengthening and increase the precipitation hardened martensitic stainless steel's hardenability. If present in sufficient quantity, manganese binds sulfur into a non-metallic compound reducing the deleterious effects of free sulfur on the ductility of the material. Manganese is also an austenite stabilizer, and levels above 1.00% by weight can cause an over-stabilization problem akin to that described above for high carbon levels.

The phosphorus in the above-described formulas may be considered to be an impurity. As such, phosphorous may be tolerated to levels of 0.040% by weigh due to its tendency to decrease ductility by segregating to grain boundaries when tempering between 700° F. and 900° F.

The sulfur in the above-described formulas may be considered to be an impurity as it may improve machinability at the cost of a decrease in ductility and toughness. Due to the negative impact on ductility and toughness, sulfur levels are tolerated to a maximum of 0.010% by weight for applications where ductility and toughness are critical. On the other hand, sulfur levels of 0.100% by weight may be tolerated where improvement in machinability is desired.

The silicon in the above-defined formulas may be used for de-oxidation during steel making. Additionally, the silicon may increase oxidation resistance, impart a mild increase in strength due to solid solution strengthening, and increase the hardenability of the precipitation hardened martensitic stainless steel. Silicon mildly stabilizes ferrite, and silicon levels between 0.15% and 0.65% by weight are desirable for de-oxidation and phase stabilization in the material. Furthermore, silicon increases the solubility of copper in iron and increases the time for precipitation hardening. In one embodiment, the silicon should be greater than 0.15% when the copper may be 1.00% by weight.

The vanadium of the above-described formulas may strongly enhance the hardenability, may improve the wear resistance when combined with carbon to form metal carbide, and may help promote fine grain through the pinning of grain boundaries through the precipitation of fine carbides, nitride, or carbonitride particles. Niobium may also be used in combination with vanadium to enhance grain refinement. While a vanadium content up to 0.15% may aid in grain refinement and hardenability, levels of vanadium above 0.15% by weight may detrimentally decrease toughness through the formation of large carbides. The precipitation hardened martensitic steel may comprise between 0% and 0.15% vanadium.

The niobium of the above-described formulas may have a negative effect on hardenability by removing carbon from solid solution, but may produce strengthening by the precipitation of fine carbides, nitride, or carbonitride particles, and may help promote fine grain through the pinning of grain boundaries through the precipitation of fine carbides, nitride, or carbonitride particles. These finely dispersed particles may not be readily soluble in the steel at the temperatures of hot working or heat treatment so they may serve as nuclei for the formation of new grains thus enhancing grain refinement. The very strong affinity of carbon by niobium may also aid in increasing the resistance to intergranular corrosion by preventing the formation of other grain boundary carbides. To mitigate the negative effect of niobium on hardenability, vanadium may be added. The precipitation hardened martensitic steel may comprise between 0% and 0.15% niobium.

The aluminum in the above-expressed formulas may be an effective de-oxidizer when used during steel making and provides grain refinement when combined with nitrogen to form fine aluminum nitrides. Aluminum may contribute to strengthening by combining with nickel to form nickel aluminide particles. Aluminum levels must be kept below 0.09% by weight to ensure preferential stream flow during ingot teeming. Moreover, the aluminum appears to improve the notch impact strength of copper bearing steels.

Example 1

The method of making the cylinder 28, the plunger 30 and the end block 32 with the precipitation hardened martensitic stainless steel disclosed herein comprises the steps of melting, forming, heat treatment and controlled material removal to obtain the final desired shape. Each of these steps will be discussed in more detail below.

The melting process for the precipitation hardened martensitic stainless steel disclosed herein does not differ from current steelmaking practice. Examples of viable melting processes include, but are not limited to, the utilization of an electric arc furnace, induction melting, and vacuum induction melting. In each of these processes, liquid steel is created and alloy is added to make the desired composition. Subsequent refining processes can be used. Depending on the process used, the protective slag layer that is created for the melting process can have a high content of oxidized alloy. Reducing agents can be added during the melting process to cause the alloying elements to revert back from the slag into the steel bath. Conversely, the metal and slag could also be processed in a vessel to lower the carbon content as well as preferentially revert the alloy in the slag back into the bath through the use of an argon-oxygen decarburization (AOD) vessel or a vacuum-oxygen decarburization (VOD) vessel. The liquid steel with the desired chemistry can be continuously poured into strands or cast into ingots.

Next, the solidified strand or ingot can be formed using typical metal forming processes, such as, but not limited to, hot working to a desired shape by rolling or forging. To aid in forming the strand or ingot may be heated in to a temperature in the range of 2100° F. to 2200° F. to make the material plastic enough to deform. Preferably, the deformation can continue as long as the temperature does not fall below 1650° F., as deformation below this temperature may result in surface cracking and tearing.

Subsequent to forming, heat treatment may take place in order to achieve the desired mechanical properties. The formed material may be heat treated in furnaces, such as, but not limited to, direct fired, indirect fired, atmosphere, and vacuum furnaces. The steps that the formed material requires to achieve the desired mechanical properties is exposure to a high temperature to allow the material to transform to austenite as well as to put copper into solution, followed cooling the material in air or in a quench media to form a predominantly martensitic matrix and subsequently followed by a lower temperature thermal cycle that tempers the martensite and causes the dissolved copper to precipitate and strengthen the material. Depending on the temperature chosen, there may also be a secondary hardening effect generated by a molybdenum addition to the alloy. The high temperature process occurs in the range of 1800° F. to 1900° F. The lower temperature cycle is in the range of 450° to 750° F. or 1050° F. to 1300° F. The 750° F. to 1050° F. range is avoided due the decrease in toughness and corrosion resistance when processed in this range. Typical processing uses the 1050° F. to 1300° F. temperature range. Formed material processed at the lower end of this range will have higher strength, while material processed at the higher end of the range will have better ductility, toughness, and corrosion resistance. After the lower temperature process, material will comprise a tempered martensitic structure with copper precipitates, and may secondarily include molybdenum preciptates.

Subsequently, the hardened formed material can be subjected to a controlled material removal process to obtain the final desired shape profile as necessary. Examples of common processes utilized to make the cylinder 28, the plunger 30 and the end block 32 from the hardened material include, but are not limited to, are milling, turning, grinding, and cutting.

Example compositions of the precipitation hardened martensitic stainless steels disclosed herein are listed below in Tables 1-3.

Example Precipitation Hardened Martensitic Stainless Steel Compositions

TABLE 1

| Example A | | |
|---|---|---|
| Element | Mass % Low | Mass % High |
| C | 0.08 | 0.18 |
| Mn | 0.30 | 1.00 |
| P | 0.000 | 0.040 |
| S | 0.000 | 0.100 |
| Si | 0.15 | 0.65 |
| Ni | 0.65 | 1.15 |
| Cr | 10.50 | 14.00 |
| Mo | 0.40 | 0.60 |
| Cu | 0.85 | 1.30 |
| Al | 0.010 | 0.090 |
| V | 0.00 | 0.15 |
| Nb | 0.00 | 0.15 |
| Nb + V | | |
| Ta | | residual |
| W | | residual |
| Fe | balance | balance |

TABLE 2

| Example B | | |
|---|---|---|
| Element | Mass % Low | Mass % High |
| C | 0.10 | 0.18 |
| Mn | 0.30 | 0.80 |
| P | 0.000 | 0.040 |
| S | 0.000 | 0.100 |
| Si | 0.25 | 0.60 |
| Ni | 0.65 | 1.15 |
| Cr | 11.50 | 14.00 |
| Mo | 0.40 | 0.60 |
| Cu | 0.85 | 1.30 |
| Al | 0.010 | 0.090 |
| V | 0.00 | 0.15 |
| Nb | 0.00 | 0.15 |
| Nb + V | | |
| Ta | | residual |
| W | | residual |
| Fe | balance | balance |

TABLE 3

| Example C | | |
|---|---|---|
| Element | Mass % Low | Mass % High |
| C | 0.13 | 0.18 |
| Mn | 0.30 | 0.50 |
| P | 0.000 | 0.040 |
| S | 0.000 | 0.010 |
| Si | 0.30 | 0.50 |
| Ni | 0.65 | 0.95 |
| Cr | 12.00 | 13.50 |
| Mo | 0.43 | 0.57 |
| Cu | 1.00 | 1.30 |
| Al | 0.015 | 0.045 |
| V | 0.00 | 0.15 |
| Nb | 0.00 | 0.07 |
| Nb + V | 0.00 | 0.15 |
| Ta | | residual |
| W | | residual |
| Fe | balance | balance |

INDUSTRIAL APPLICABILITY

In operation, the teachings of the present disclosure can find applicability in many applications including, but not limited to, pumps designed to deliver materials under high pressure and/or highly abrasive materials. For example, such pumps may include, but are not limited to, mud pumps, concrete pumps, well service pumps and the like. Although applicable to any pump designed to deliver materials under high pressure and/or highly abrasive materials, the present disclosure may be particularly applicable to a reciprocating pump 10 used to deliver hydraulic fracturing material or a proppant material into a gas or oil wellbore. More specifically, the present disclosure finds usefulness by increasing the service life of a cylinder 28, a plunger 30 or an end block 32 of the fluid end 14 of a reciprocating pump 10 used to deliver hydraulic fracturing material or a proppant material into a gas or oil wellbore.

For example, the cylinder 28 of the reciprocating pump 10 disclosed herein may employ the precipitation hardened martensitic stainless steel disclosed herein in order to increase the service life of the reciprocating pump 10. The precipitation hardened martensitic stainless steel may comprise between 0.08% and 0.18% by weight carbon, between 10.50% and 14.00% by weight chromium, between 0.65% and 1.15% by weight nickel, between 0.85% and 1.30% by weight copper, and iron. In addition, the precipitation hardened martensitic stainless steel may comprise a first precipitate comprising the copper. The precipitation hardened martensitic stainless steel may further comprise between 0.40% and 0.60% by weight molybdenum and a second precipitate comprising the molybdenum. In addition, the precipitation hardened martensitic stainless steel may additionally comprise between 0.30% and 1.00% by weight manganese. Furthermore, the precipitation hardened martensitic stainless steel may further comprise between 0% and 0.040% by weight phosphorus. Moreover, the precipitation hardened martensitic stainless steel may comprise between 0% and 0.100% by weight sulfur. Additionally, the precipitation hardened martensitic stainless steel may comprise between 0.15% and 0.65% by weight silicon. Furthermore, the precipitation hardened martensitic stainless steel may comprise between 0% and 0.15% by weight vanadium. In addition, the precipitation hardened martensitic stainless steel may comprise between 0% and 0.15% niobium. Lastly, the precipitation hardened martensitic stainless steel may comprise between 0.01% and 0.09% by weight aluminum.

Additionally, the plunger 30 of the reciprocating pump 10 disclosed herein may employ the precipitation hardened martensitic stainless steel disclosed herein in order to increase the service life of the reciprocating pump 10. The precipitation hardened martensitic stainless steel may comprise between 0.08% and 0.18% by weight carbon, between 10.50% and 14.00% by weight chromium, between 0.65% and 1.15% by weight nickel, between 0.85% and 1.30% by weight copper, and iron. In addition, the precipitation hardened martensitic stainless steel of the plunger 30 may comprise a first precipitate comprising the copper. The precipitation hardened martensitic stainless steel may further comprise between 0.40% and 0.60% by weight molybdenum and a second precipitate comprising the molybdenum. In addition, the precipitation hardened martensitic stainless steel may additionally comprise between 0.30% and 1.00% by weight manganese. Furthermore, the precipitation hardened martensitic stainless steel may further comprise between 0% and 0.040% by weight phosphorus. Moreover, the precipitation hardened martensitic stainless steel may comprise between 0% and 0.100% by weight sulfur. Additionally, the precipitation hardened martensitic stainless steel may comprise between 0.15% and 0.65% by weight silicon. Furthermore, the precipitation hardened martensitic stainless steel may comprise between 0% and 0.15% by weight vanadium. In addition, the precipitation hardened martensitic stainless steel may comprise between 0% and 0.15% niobium. Lastly, the precipitation hardened martensitic stainless steel may comprise between 0.01% and 0.09% by weight aluminum.

Moreover, the end block 32 of the reciprocating pump 10 disclosed herein may employ the precipitation hardened martensitic stainless steel disclosed herein in order to increase the service life of the reciprocating pump 10. The precipitation hardened martensitic stainless steel may comprise between 0.08% and 0.18% by weight carbon, between 10.50% and 14.00% by weight chromium, between 0.65% and 1.15% by weight nickel, between 0.85% and 1.30% by weight copper, and iron. In addition, the precipitation hardened martensitic stainless steel may comprise a first precipitate comprising the copper. The precipitation hardened martensitic stainless steel of the end block 32 may further comprise between 0.40% and 0.60% by weight molybdenum and a second precipitate comprising the molybdenum. In addition, the precipitation hardened martensitic stainless steel may additionally comprise between 0.30% and 1.00% by weight manganese. Furthermore, the precipitation hardened martensitic stainless steel may further comprise between 0% and 0.040% by weight phosphorus. Moreover, the precipitation hardened martensitic stainless steel may comprise between 0% and 0.100% by weight sulfur. Additionally, the precipitation hardened martensitic stainless steel may comprise between 0.15% and 0.65% by weight silicon. Furthermore, the precipitation hardened martensitic stainless steel may comprise between 0% and 0.15% by weight vanadium. In addition, the precipitation hardened martensitic stainless steel may comprise between 0% and 0.15% niobium. Lastly, the precipitation hardened martensitic stainless steel may comprise between 0.01% and 0.09% by weight aluminum.

The above description is meant to be representative only, and thus modifications may be made to the embodiments described herein without departing from the scope of the disclosure. Thus, these modifications fall within the scope of the present disclosure and are intended to fall within the appended claims.

What is claimed is:

1. A precipitation hardened martensitic stainless steel, comprising:

from greater than 0.10% up to 0.18% by weight carbon;

between 10.50% and 14.00% by weight chromium;

between 0.65% and 1.15% by weight nickel;

between 0.85% and 1.30% by weight copper;

iron; and a first precipitate comprising the copper.

2. The precipitation hardened martensitic stainless steel according to claim 1, further comprising between 0.40% and 0.60% by weight molybdenum and a second precipitate comprising the molybdenum.

3. The precipitation hardened martensitic stainless steel according to claim 1, further comprising between 0.30% and 1.00% by weight manganese.

4. The precipitation hardened martensitic stainless steel according to claim 1, further comprising between 0% and 0.040% by weight phosphorus.

5. The precipitation hardened martensitic stainless steel according to claim 1, further comprising between 0% and 0.100% by weight sulfur.

6. The precipitation hardened martensitic stainless steel according to claim 1, further comprising between 0.15% and 0.65% by weight silicon.

7. The precipitation hardened martensitic stainless steel according to claim 1, further comprising between 0% and 0.15% by weight vanadium.

8. The precipitation hardened martensitic stainless steel according to claim 1, further comprising between 0% and 0.15% by weight niobium.

9. The precipitation hardened martensitic stainless steel according to claim 1, further comprising between 0.01% and 0.09% by weight aluminum.

10. An end block, comprising:

a body extending between a front side, a back side, a left side, a right side, a top side and a bottom side, a first bore extending through the body between an inlet port and an outlet port, a cylinder bore extending between a cylinder port and the first bore, and the body comprising a precipitation hardened martensitic stainless steel comprising from greater than 0.10% up to 0.18% by weight carbon, between 10.50% and 14.00% by weight chromium, between 0.65% and 1.15% by weight nickel, between 0.85% and 1.30% by weight copper, iron and a first precipitate comprising the copper.

11. The end block according to claim 10, the precipitation hardened martensitic stainless steel further comprising between 0.40% and 0.60% by weight molybdenum and a second precipitate comprising the molybdenum.

12. The end block according to claim 10, the precipitation hardened martensitic stainless steel further comprising between 0.30% and 1.00% by weight manganese.

13. The end block according to claim 10, the precipitation hardened martensitic stainless steel further comprising between 0% and 0.040% by weight phosphorus.

14. The end block according to claim 10, the precipitation hardened martensitic stainless steel further comprising between 0% and 0.100% by weight sulfur.

15. The end block according to claim 10, the precipitation hardened martensitic stainless steel further comprising between 0.15% and 0.65% silicon.

16. The end block according to claim 10, the precipitation hardened martensitic stainless steel further comprising between 0% and 0.15% by weight vanadium.

17. The end block according to claim 10, the precipitation hardened martensitic stainless steel further comprising between 0% and 0.15% by weight niobium.

18. The end block according to claim 10, the precipitation hardened martensitic stainless steel further comprising between 0.01% and 0.09% by weight aluminum.

19. A reciprocating pump, comprising:

a crankshaft;

a crank arm rotationally engaged with the crankshaft;

a connecting rod operatively connected to the crank arm;

a plunger operatively connected to the connecting rod;

a cylinder configured to operatively engage the plunger; and an end block, the end block including a body extending between a front side, a back side, a left side, a right side, a top side and a bottom side, the body comprising a first bore extending through the body between an inlet port and an outlet port and a cylinder bore extending between a cylinder port and the first bore, and the body comprising a precipitation hardened martensitic stainless steel comprising from greater than 0.10% up to 0.18% by weight carbon, between 10.50% and 14.00% by weight chromium, between 0.65% and 1.15% by weight nickel, between 0.85% and 1.30% by weight copper, iron and a first precipitate comprising the copper.

20. The reciprocating pump according to claim 19, the precipitation hardened martensitic stainless steel further comprising between 0.40% and 0.60% by weight molybdenum and a second precipitate comprising the molybdenum.

21. The reciprocating pump according to claim 19, the precipitation hardened martensitic stainless steel further comprising between 0.30% and 1.00% by weight manganese.

22. The reciprocating pump according to claim 19, the precipitation hardened martensitic stainless steel further comprising between 0% and 0.040% by weight phosphorus.

23. The reciprocating pump according to claim 19, the precipitation hardened martensitic stainless steel further comprising between 0% and 0.100% by weight sulfur.

24. The reciprocating pump according to claim 19, the precipitation hardened martensitic stainless steel further comprising between 0% and 0.15% by weight vanadium.

25. The reciprocating pump according to claim 19, the precipitation hardened martensitic stainless steel further comprising between 0% and 0.15% niobium.

26. The reciprocating pump according to claim 19, the precipitation hardened martensitic stainless steel further comprising between 0.15% and 0.65% silicon and between 0.01% and 0.09% by weight aluminum.

* * * * *